United States Patent [19]

Foldes

[11] 4,075,590

[45] Feb. 21, 1978

[54] BOBBIN CONSTRUCTION FOR ELECTRICAL COILS

[76] Inventor: Stephen Foldes, 5 Riverside Drive, Binghamton, N.Y. 13905

[21] Appl. No.: 770,573

[22] Filed: Feb. 22, 1977

[51] Int. Cl.[2] ..... H01F 27/26

[52] U.S. Cl. ..... 336/192; 336/198; 336/210

[58] Field of Search ..... 336/192, 198, 208, 90, 336/92, 98, 210

[56] References Cited

U.S. PATENT DOCUMENTS

| | | | |
|---|---|---|---|
| 3,354,417 | 11/1967 | Davis | 336/192 X |
| 3,524,156 | 8/1970 | Horbach | 336/208 |
| 3,665,358 | 5/1972 | Leuck et al. | 336/198 |
| 3,939,362 | 2/1976 | Grimes et al. | 336/198 X |

FOREIGN PATENT DOCUMENTS

| | | | |
|---|---|---|---|
| 2,006,736 | 8/1971 | Germany | 336/208 |

*Primary Examiner*—Thomas J. Kozma
*Attorney, Agent, or Firm*—Frederick E. Bartholy

[57] ABSTRACT

A bobbin construction, particularly for windings surrounding an assembly of ferromagnetic laminations, is described. It consists of a skeletal frame member of molded plastic having an elongated shape, generally of rectangular cross section, over which a winding may be wound. The frame member has laterally extending walls which define the space for the windings and axially extending walls defining the space of the laminations. The latter walls are so constructed as to support covers for enclosure of the core assembly.

2 Claims, 6 Drawing Figures

FIG. 1
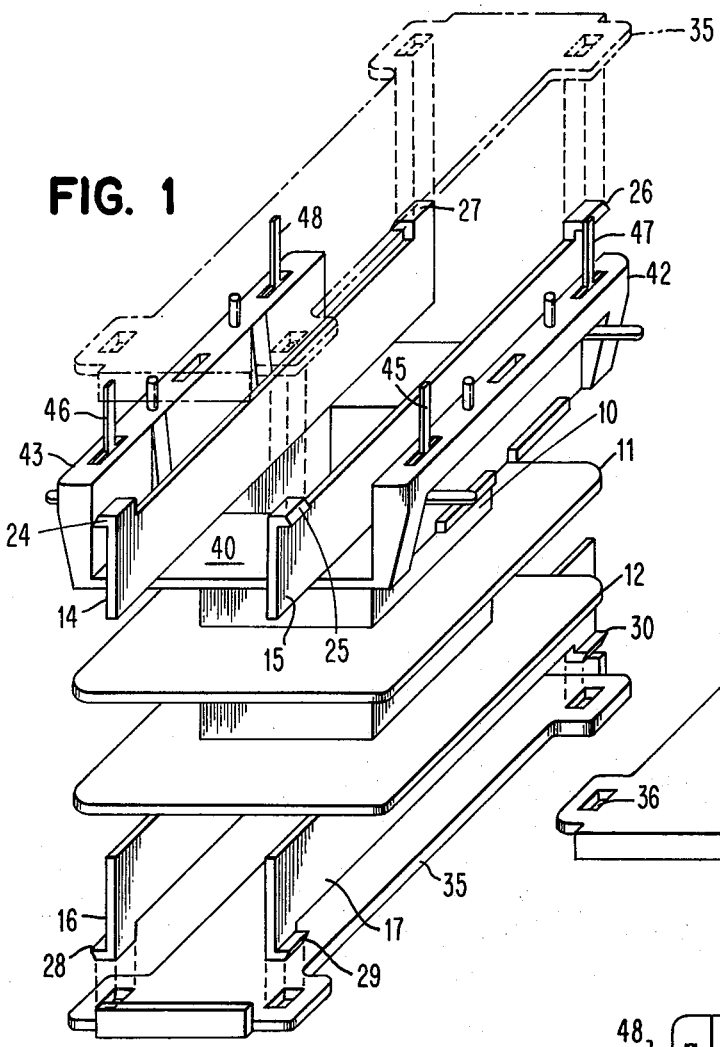
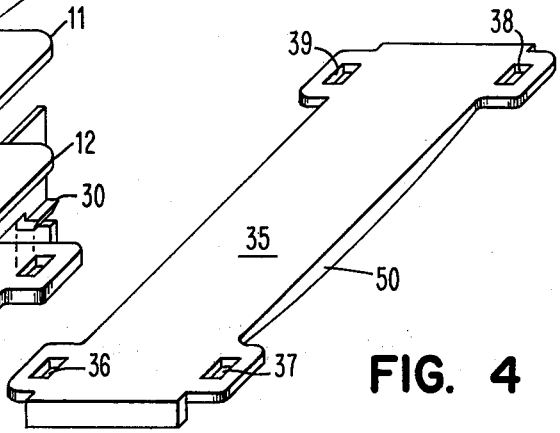
FIG. 4
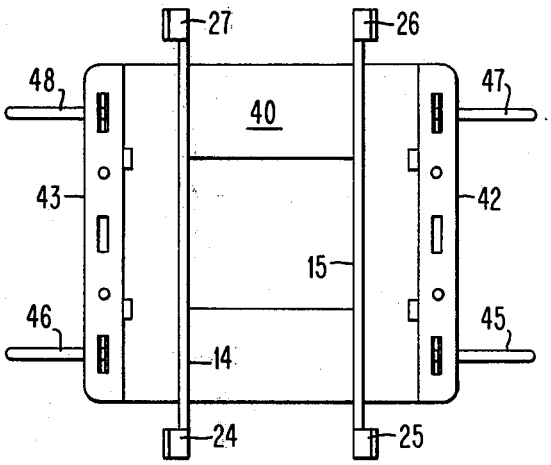
FIG. 2
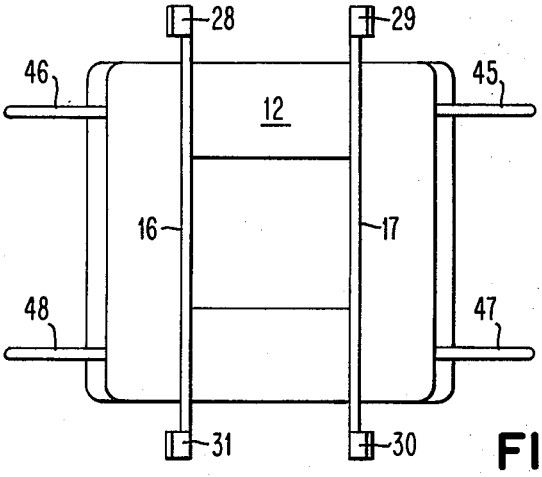
FIG. 3

BOBBIN CONSTRUCTION FOR ELECTRICAL COILS

BACKGROUND OF THE INVENTION

1. Field of the Invention

The invention relates, in general, to bobbins upon which electrical coils are wound for the purpose of providing an inductor or a transformer as the case may be.

More particularly, the invention is directed to a bobbin construction in the form of a molded frame member which is intended to incorporate ferromagnetic laminations in addition to windings placed over the bobbin.

2. Description of the Prior Art

Bobbins, in a great variety of forms, have been described for the purpose of retaining a winding, as well as for housing laminations.

In one example, as seen in U.S. Pat. No. 2,249,057, the component elements include a core and flanges with an inwardly recessed central portion to fit over the core. When these parts are assembled, a bridge member is utilized to hold the flanges together. This type of structure requires hand assembly which is not only time consuming but involves labor costs as well.

In U.S. Pat. No. 2,899,655, the bobbin is of molded plastic and space is provided therewithin to be filled up with laminations. This structure has the disadvantage that the core is only held by frictional contact of the bobbin and must therefore be solidly stacked. Temperature variations, particularly in service when the windings carry current may cause expansion of the bobbin body, allowing loosening of the core members. Among these, the "I" laminations have no other support than lateral pressure; consequently, some may fall out.

U.S. Pat. No. 3,644,156 discloses a method of assembly of bobbins of various sizes wherein the flange members form no integral part of the tubular portion over which the wires are to be wound. A solid guide form is used, accepting various desired lengths of bobbin sleeves, the flanges being then placed over the particular length of sleeves chosen to complete the structure. In this type of manufacture, the selection of the lengths of the sleeves and their assembly over the guide member is, of course, time consuming and involves glueing of the assembled parts.

Aside from such labor, the ferromagnetic laminations have no retention means and must be held together either by bindings or metal frame clamping.

SUMMARY OF THE INVENTION

The primary object of this invention is to provide a skeletal frame member of molded plastic material to be utilized as a bobbin for inductors or transformers employing ferromagnetic laminations.

It is a particular feature of the invention that the bobbin in accordance therewith requires no assembly of constituents parts and, by virtue of its construction, offers definite space allocations for the windings as well as for the core assembly.

The distinct advantage of the invention is that the bobbin construction, aside from being a frame member, has constituent parts easily assembled therewith for total retention and housing of the laminations.

Other objects, features and advantages will be apparent from the following description of the invention, pointed out in particularity in the appended claims, and taken in connection with the accompanying drawings, in which:

FIG. 1 is a perspective view of the skeletal frame member.

FIG. 2 is a top view thereof.

FIG. 3 is a bottom view thereof.

FIG. 4 is a view of a retaining cover.

Referring to the figures, it is seen in FIG. 1 that the construction is essentially a one-piece, molded, skeletal frame member. It consists of a substantially rectangular body 10 having laterally extending walls 11 and 12 as an integral part thereof. The space between said walls is utilized for the winding of a suitable wire in order to result in a dual coil. Obviously, if needed a continuous winding may be made to form a single coil in which the walls 11 and 12 are merely strengthening parts of the assembly.

Figure 5:
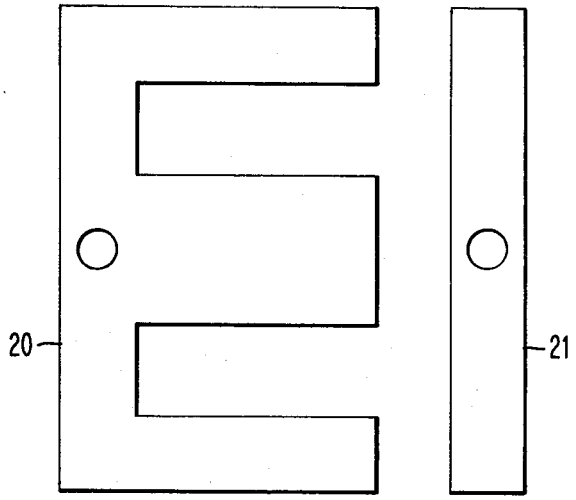
FIG. 5 illustrates the types of ferromagnetic laminations used.

Extending in the axial direction of the body 10 are walls 14 and 15 on the top portion and similar walls 16 and 17 on the bottom portion thereof. The distance between the above recited walls is so dimensioned as to enclose, in the space between them, ferromagnetic laminations which are easily inserted in a manner well known in the art. The type of laminations used are shown in FIG. 5. These are conventional, consisting of an E-shaped member 20 and an I-shaped member 21.

It is to be noted that the axially extending walls 14, 15, 16 and 17 have protuberances 24, 25, 26, 27, 28, 29, and 30 visible in FIG. 1. The protuberance 31 is not seen in this view but is illustrated in FIG. 3 which is the bottom view of the frame member shown in FIG. 1.

The purpose of these is to retain a cover 35, separately shown in FIG. 4, which has cutouts 36, 37 38 and 39 so dimensioned as to cooperate with the above recited protuberances in a snap fastener mode of retention.

Referring again to FIG. 1, it is seen that on the top portion thereof, another lateral wall 40 terminates in axially extending walls 42 and 43 which form the top of the bobbin construction. Molded in these walls are L-shaped connecting lugs 45, 46, 47 and 48, respectively. These extend below the surface of the walls 42 and 43 in order to serve as terminals for the windings to which the wire is soldered so as to provide a firm connection.

FIGS. 2 and 3 are top and bottom views, respectively, of the frame member shown in FIG. 1. The component elements shown bear corresponding reference characters.

The covers 35 are not shown here since their placement in indicated in FIG. 1. The purpose of these covers is of great importance in order to achieve one of the objects of the invention, namely, to provide a bobbin of the type utilizing ferromagnetic laminations with a minimal time for assembly, resulting in a finished product, for example, a transformer which is solid in construction.

The covers 35 on the top as well as on the bottom complete the housing for the laminations so that the latter require no external binding or retention means whatsoever. It is to be noted that the bottom of the cover 35 has a slightly curved surface 50, representing a protrusion which, upon snapping on, bears against the laminations. This results in a firm, solid assembly.

Instead of having a curved surface as above described, other means may be employed for pressing against the core lamination assembly. This may be in the form of transverse ribs on the bottom of the cover 35, or any other protruding means.

Figure 6:
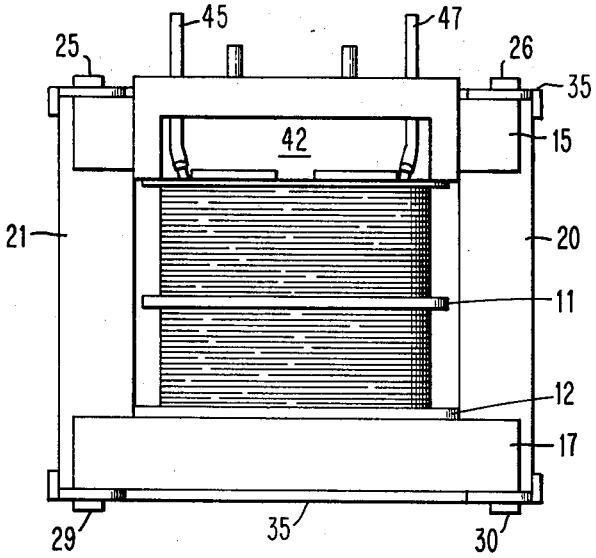
FIG. 6 is a front elevational view of the completed assembly in the form of a transformer.

The completed transformer is seen in a front elevational view in FIG. 6. It is to be noted that the assembly firmly secures the laminations 20 and 21 by virtue of the walls 15 and 17, shown here, and corresponding walls not seen in this view.

This invention in its broader aspects is not limited to the specific embodiments herein shown and described but changes may be made within the scope of the accompanying claims without departing from the principles of the invention and without sacrificing its chief advantages.

What is claimed is:

1. A bobbin construction, particularly for electrical coils having cores of ferromagnetic laminations, comprising a hollow skeletal frame member of molded plastic material over which a coil may be wound, said member having laterally extending walls defining the space for said coil and, at each end, a pair of axially-extending walls defining the space for said laminations, one of said lateral walls having axially-extending portions supporting terminal lugs for the electrical connection of said coil, said axially-extending walls having protuberant parts adapted to secure a cover member, comprising an oblong piece of flexible material having cutouts so dimensioned as to cooperate with said protuberant parts in a snap fastener mode of retention.

2. A bobbin construction in accordance with claim 2 wherein said cover member has a bottom surface of curvilinear shape adapted to flatten upon retention and in contact with the edge of said laminations, thereby exerting increased pressure thereon.

* * * * *